United States Patent [19]

Mundt et al.

[11] 3,977,280

[45] Aug. 31, 1976

[54] SEVERING METHOD AND APPARATUS FOR PHOTOGRAPHIC TRANSPARENCIES

[75] Inventors: Peter Hans Ernst Mundt; Otfried Urban, both of Garmisch-Partenkirchen; Arnold Neuhold, Farchant, all of Germany

[73] Assignee: Geimuplast Peter Mundt KG, Farchant, Germany

[22] Filed: Sept. 25, 1974

[21] Appl. No.: 509,046

Related U.S. Application Data

[63] Continuation-in-part of Ser. No. 399,403, Sept. 21, 1973, abandoned.

[30] Foreign Application Priority Data

Sept. 21, 1973 Germany ..... 7234661

[52] U.S. Cl. ..... 83/42; 83/373; 83/443; 83/578; 83/599

[51] Int. Cl.[2] ..... B26D 1/38

[58] Field of Search ..... 83/578, 203, 204, 205, 83/599, 42, 443, 373

[56] References Cited

UNITED STATES PATENTS

| | | | |
|---|---|---|---|
| 2,644,645 | 7/1953 | Bevevino | 83/578 X |
| 2,757,733 | 8/1956 | Cunningham | 83/578 |
| 2,917,883 | 12/1959 | Rock | 83/578 X |

*Primary Examiner*—Frank T. Yost
*Attorney, Agent, or Firm*—Fleit & Jacobson

[57] ABSTRACT

Photographic transparencies are successively severed from the leading end of film strip by means of an oscillatory knife and simultaneously guided by surfaces on the knife to a mounting station at which the transparencies are inserted in slide frames.

6 Claims, 4 Drawing Figures

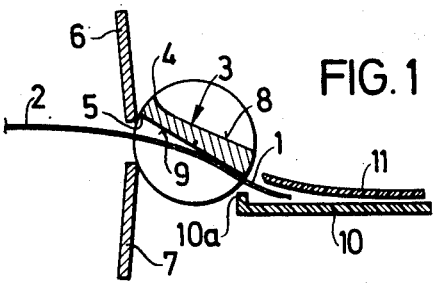
FIG. 1
FIG. 2
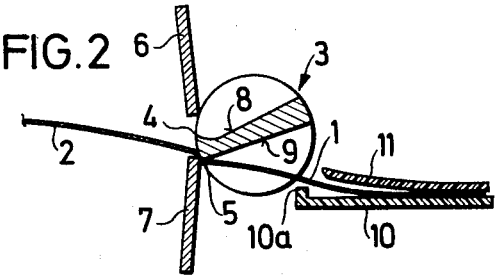
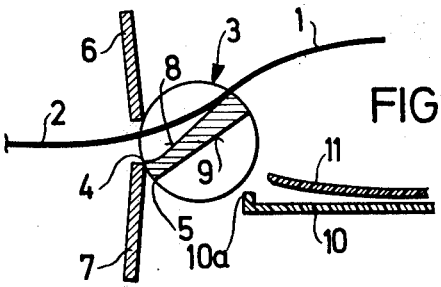
FIG. 3
FIG. 4
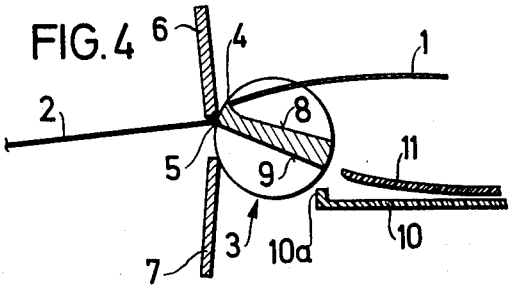

SEVERING METHOD AND APPARATUS FOR PHOTOGRAPHIC TRANSPARENCIES

This application is a continuation-in-part of Ser. No. 399,403 filed Sept. 21, 1973, now abandoned.

The invention relates to a method and apparatus for successively severing photographic transparencies from the leading end of film strip in the course of mounting the transparencies in frames to form slides.

In the preparation of slides, each transparency can be cut from a roll of film strip by hand, which is clearly time-consuming. It has therefore been proposed to mechanise the operation by employing a revolving knife which severs the leading transparency from the strip each time a cutting edge on the knife is revolved into juxtaposition with a co-operating stationary cutting edge, the film strip being intermittently fed towards the knife. Although this expedites severing of the transparencies, the latter then still need to be transported and manipulated into their respective slide frames.

The invention has for its object to speed up the severing process even further and at the same time eliminate the hitherto separate manual operation of introducing each severed transparency into its slide frame. In its preferred form, the invention also aims to provide means enabling defective film strip portions to be severed and then to bypass the mounting station to be discarded.

Accordingly, in the mounting of photographic transparencies in frames to form slides, the invention provides a method of successively severing said transparencies from the leading end of film strip by means of an oscillatory knife rotatable about an oscillatory axis and having first and second cutting edges co-operating with respective third and fourth cutting edges provided on respectively two stationary blades, the said blade edges being spaced apart and disposed substantially on an arc described by the said knife edges during oscillation, the said severing method comprising positioning said knife about its oscillatory axis so that its said second cutting edge is in a first inoperative position adjacent said third cutting edge with both knife edges disposed substantially beyond the space separating the blade edges, feeding a leading end of the film strip between the spaced blade edges from a side thereof remote from the oscillatory knife to project a predetermined distance beyond the blades and simultaneously guiding said leading end with the aid of said knife to a mounting station for the severed transparencies, rotating said knife in a first direction from said first inoperative position so that the knife edges sweep across the space separating the blade edges, whereby said second cutting edge co-operates with said fourth cutting edge to sever the leading transparency from the strip along a line of cut parallel to said oscillatory axis, continuing rotation of the knife in said first direction until said first cutting edge has substantially passed the said space separating the blade edges and said second cutting edge has reached a second inoperative position, and thereafter rotating the knife in a second, reverse, direction to return said second cutting edge from its said second to its said first inoperative position.

Further aspects of the invention, including an apparatus for carrying out the aforementioned method, will now be described with reference to the accompanying diagrammatic drawings wherein all of FIGS. 1 to 4 illustrate the same severing apparatus in cross-section but during different stages of operation.

The illustrated severing apparatus forms part of a framing machine for transparencies and comprises an oscillatory knife 3 having an oscillatory axis substantially midway of its length about which it can be rotated. The knife 3 is provided with closely spaced first and second cutting edges 4 and 5, respectively. A pair of stationary blades 6, 7 is disposed to one side of the oscillatory knife. Each blade is provided with a cutting edge, these blade edges being spaced apart and disposed substantially on an arc described by the knife edges 4, 5 during oscillation. All the cutting edges extend across the width of a film strip 2 that is to be severed, the line of cut produced by the edges being parallel to the oscillatory axis of the knife. A deflecting or guide surface 8 for the film strip 2 is provided on one face of the knife 3 and extends from the cutting edge 4 to beyond the oscillatory axis. On the other face, the knife has a further guide surface 9 which extends from the cutting edge 5 to beyond the oscillatory axis. The cutting edges merge into the respective guide surfaces.

A mounting station 10 for each severed transparency, such as 1, at the leading end of the film strip 2 is provided adjacent the knife on a side thereof remote from the blades 6, 7. At this station 10, the severed transparency is inserted in a two-part slide frame 11 of, say, plastics material. A base part of the frame 11 is provided with a peripheral bead or ledge 10*a* with which a cover part of the frame can be engaged after the transparency has been mounted by being interposed between the base and cover parts.

Referring specifically to FIG. 1, this shows the oscillatory knife 3 in a rotary position at which its cutting edge 5 is in a first inoperative position adjacent the cutting edge of the stationary blade 6, both of the knife edges 4 and 5 being disposed substantially beyond the space separating the blade edges so that the leading end of the strip 2 can be fed between the blades without encountering an obstruction. The strip 2 is being fed from left to right in FIG. 1 and feeding continues until a predetermined length (equal to the length of the first transparency 1 to be severed) projects beyond the blades 6, 7. During such feeding, and with the knife 3 remaining in its FIG. 1 inoperative position, the leading strip end is guided by the surface 9 to a lower level so as to approach the mounting station 10 and be inserted in the frame 11 without striking the ledge 10*a*.

The blade 3 is then rotated about its oscillatory axis for a fraction of one revolution in an anti-clockwise direction. In the course of such rotation, the knife edge 5 co-operates with the cutting edge on the blade 7 in the manner shown in FIG. 2, to sever the leading transparency 1 that is being mounted. Rotation of the knife in the same direction is continued, until the knife edge 4 has substantially cleared the space between the blades 6, 7 (see FIG. 3) so that a new leading end 1 of the strip 2 will not be obstructed as it is fed between the blades. The cutting edge 5 is now in a second inoperative position, the knife being stationary.

The new leading strip end 1 in FIG. 3 can be guided by the surface 8 to bypass the mounting station 10 and reach a second mounting station (not shown) so that, as the knife is then rotated in a clockwise direction, during which time the cutting edge 5 returns to its first inoperative position shown in FIG. 1, the edge 4 co-operates with the edge on the blade 6 (FIG. 4) to sever another transparency that is to be mounted in a frame.

In the preferred form of the invention, however, only the knife edge 5 is used in co-operation with the blade 7 to sever transparencies that are to be mounted, the guide surface 9 being employed to guide each transparency to the mounting station 10. For this purpose, the return oscillation of the knife from the second inoperative position is an idling movement, no feeding of the strip taking place until the knife is back in the FIG. 1 position. Only if the leading end of the strip 2 is defective, for example if it contains a splice or some other unmountable defect, will the strip be fed between the blades 6, 7 and guided by the surface 8 whilst the knife 3 is in the FIG. 3 position and the defective portion is then cut off between the edge 4 and blade 6 (FIG. 4) to be discarded. It is preferred, therefore, that a mountable transparency be severed from the strip only during each forward (anti-clockwise) oscillation of the knife 3, the clockwise rotation serving to return the knife to its starting position without operating on the strip unless the leading end of the strip happens to be defective. It will, however, be evident that the first-mentioned double-acting mode of operation is feasible and may in some cases even be desirable. For example, when the equipment is being used to trim the leading and trailing margins of pictures on a strip of photographic paper, the knife edge 5 may sever the leading picture from the strip on the forward oscillation of the knife, the edge 4 may sever the unprinted or unexposed separating margin on the return oscillation, and so on.

Apart from the higher severing and mounting rate that is achievable by means of the method and apparatus of the invention because the knife does not have to be turned a complete revolution, and the fact that the construction facilitates the elimination of rejected transparencies or defective strip portions before they are mounted, thereby ensuring that the frames are not wasted on useless film strip portions, a considerable advantage of the present invention is the feature of guiding the film strip to its desired location before the severing step takes place. Since it is not desirable for the picture areas of the transparencies to be subjected to the danger of scratching, at least the guide surface 9 of the knife 3 is preferably set back adjacent to the picture area so that it makes contact only with the usually perforated longitudinal marginal portions of the strip. However, the cutting edges 4, 5 necessarily extend across the entire width of the film strip and they are preferably designed so that the line of cut commences simultaneously at both longitudinal edges of the strip and is continued from both sides towards the centre in a direction parallel to the oscillatory axis of the knife.

We claim:

1. A method of positioning photographic film in a mounting means comprising the steps of:

pushing a photographic film strip having a leading end along a feed path to a cutting station located in said feed path;

providing said cutting station with severing means for severing said film strip into film segments each having a predetermined length;

pushing said film strip leading end through said cutting station, said film strip leading end being unsupported and maintained on said feed path solely by the stiffness of said film strip;

deflecting said film strip after said leading end has passed said cutting station;

continuing to push said deflected film strip with said leading end unsupported through said cutting station, said length being equal to the length of said segments;

pushing and continuously guiding said film strip to a mounting station, said leading edge remaining unsupported;

positioning said film segments in a mounting means located at said film mounting station; and severing said film strip to form said film segments.

2. The method of claim 1, wherein a new leading end of the film strip is fed to said cutting station after said film strip has been severed.

3. The method of claim 1 wherein, a defective unmountable leading film strip portion is fed through said cutting station to project a predetermined distance beyond said cutting station and is simultaneously guided to bypass said mounting station, said defective portion being severed from the film strip along a line of cut parallel to said severing means.

4. Apparatus for mounting photographic transparencies, comprising:

mounting means for mounting the photographic transparencies;

a pair of stationary cutting blades, having mutually facing stationary cutting edges which are spaced apart a distance substantially greater than the thickness of the photographic transparencies;

an oscillating cutting blade rotatably mounted at a location intermediate said stationary cutting blades and said mounting means, said oscillating cutting blade having a pair of cutting edges on one end which cutting edges are located on opposite sides of said blade and are positioned on an arcuate path which intersects said stationary cutting edges so that each of said oscillating blade cutting edges cooperate with one of said stationary cutting edges to sever the photographic transparencies from a film strip when said oscillating blade is oscillated; and a guiding surface located on one face of said oscillating cutting blade and extending from one of said oscillating blade cutting edges to the vicinity of the other end of said oscillating blade for guiding one end of said film strip to said mounting means before said oscillating blade severs the photographic transparencies from said film strip.

5. Apparatus according to claim 4, including a further guide surface on said oscillating cutting blade extending from one of said oscillating blade cutting edges beyond the oscillatory axis of said oscillating cutting blade, said further guide surface being directed to bypass said mounting station when said oscillating cutting blade is in an inoperative position.

6. Apparatus according to claim 4, wherein said guide surface is recessed to make contact only with the longitudinal marginal portions of said film strip.

* * * * *